United States Patent [19]

Mascia et al.

[11] 4,141,448

[45] Feb. 27, 1979

[54] INTEGRATED DOUBLE SERVING PACKAGES WITH HANGER

[75] Inventors: Carmen T. Mascia, Clarendon Hills; Thomas F. Jordan, Oak Park, both of Ill.

[73] Assignee: The Continental Group, Inc., New York, N.Y.

[21] Appl. No.: 878,182

[22] Filed: Feb. 14, 1978

[51] Int. Cl.[2] ..... B65D 65/22; B65D 75/24

[52] U.S. Cl. ..... 206/485; 206/431; 206/499; 206/590; 206/806; 229/41 C

[58] Field of Search ..... 206/45.14, 145, 152–154, 206/194–195, 303, 329, 391, 394–395, 400, 430–431, 434, 445, 476, 485–486, 490–491, 499, 585, 587–590, 806; 229/40, 41 C, 87 R

[56] References Cited

U.S. PATENT DOCUMENTS

| | | | |
|---|---|---|---|
| 2,514,858 | 7/1950 | Gray | 206/431 X |
| 2,986,272 | 5/1961 | Kruse | 206/431 |
| 3,080,965 | 3/1963 | Kuchenbecker | 206/431 |
| 3,152,695 | 10/1964 | Stewart, Jr. | 206/485 |
| 3,561,594 | 2/1971 | Jorgensen | 206/431 X |
| 3,638,990 | 1/1972 | Huault | 206/431 X |
| 3,670,879 | 6/1972 | Williard et al. | 206/431 |

FOREIGN PATENT DOCUMENTS

| | | | |
|---|---|---|---|
| 527927 | 7/1956 | Canada | 206/485 |
| 1469554 | 1/1967 | France | 206/485 |

*Primary Examiner*—Steven E. Lipman
*Attorney, Agent, or Firm*—Charles E. Brown

[57] ABSTRACT

An integrated double serving package with hanger wherein a pair of bowl-like containers having removable covers are held together in a display package by a retaining sleeve which is of a polygonal cross section and including flat panels having notches therein receiving the projections of the containers and covers. The sleeve has end portions secured together by a projecting hanger portion whereby the package may be readily hung from a hook or the like for display purposes.

15 Claims, 6 Drawing Figures

INTEGRATED DOUBLE SERVING PACKAGES WITH HANGER

This invention relates in general to new and useful improvements in container packages, and more particularly to a container package wherein two containers are disposed in end-to-end relation by means of a retaining sleeve and wherein the retaining sleeve is provided with a hanger portion to facilitate the hanging and displaying of the package.

We are aware that the idea of taping two containers together has been used commercially. We are also aware of the United States patents to Goldberg (U.S. Pat. No. 2,151,025); Andres (U.S. Pat. No. 2,256,995); and Bolton (U.S. Pat. No. 3,630,350).

In accordance with this invention, two conventional bowls (dishes) having replacable covers disposed in end-to-end relation with the covers facing one another and thereafter a sleeve or band is wrapped therearound with the covers projecting through notches formed in flat panels of the sleeve so as to form an interlocked package. The sleeve serves to retain the covers on the bowls or containers during handling or shipping.

A further feature of the invention is to provide the retaining sleeve with a hanger so that the package may be readily hung from a hook or the like for display purposes. Thus the package is suitable for dispensing food products, such as snack food, nutmeats and the like.

With the above and other objects in view that will hereinafter appear, the nature of the invention will be more clearly understood by reference to the following detailed description, the appended claims and the several views illustrated in the accompanying drawing.

Figures 1, 2, 3, 4, 5, 6:
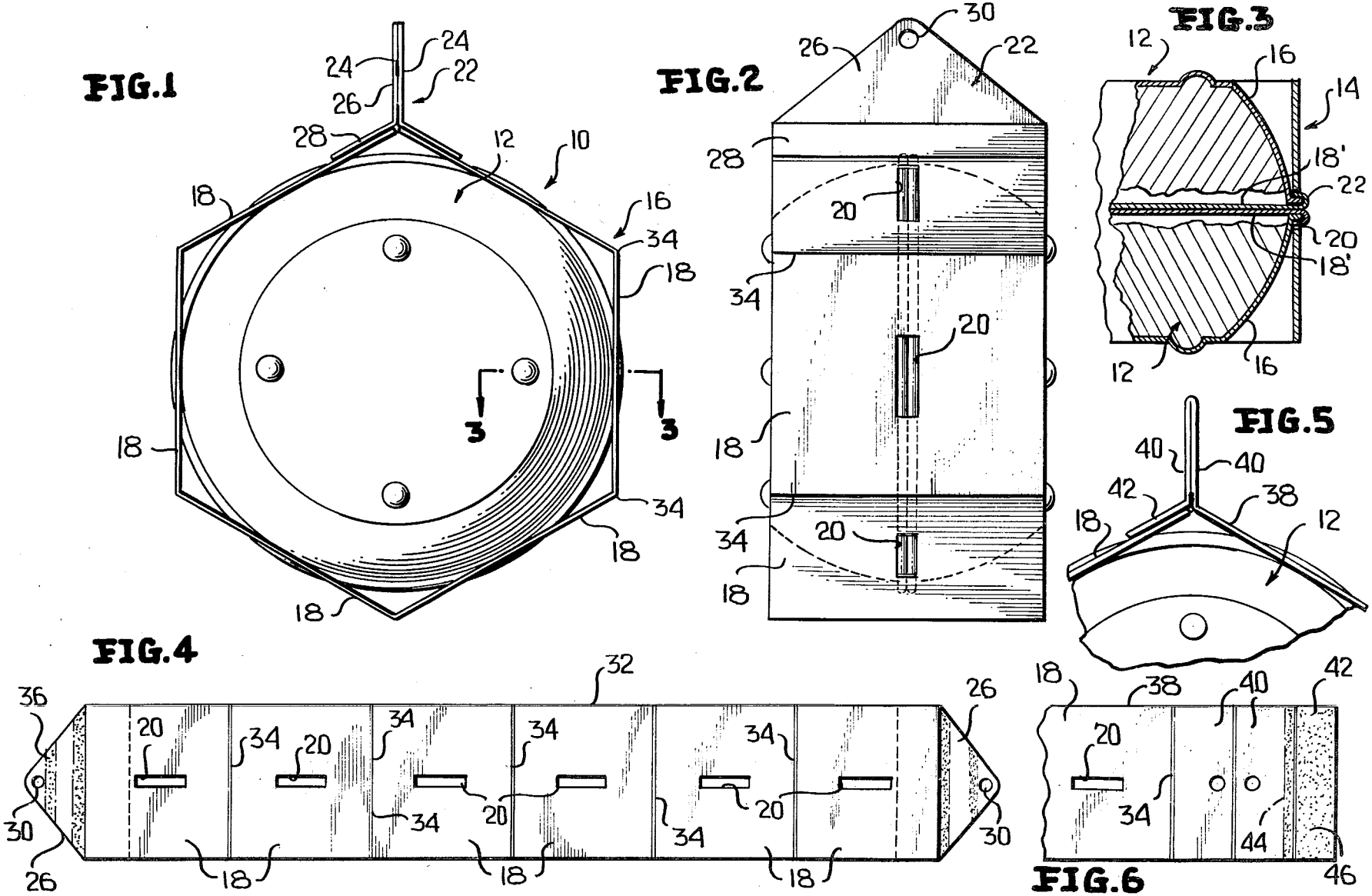
FIG. 1 is a side elevational view of the package formed in accordance with this invention.
FIG. 2 is a front elevational view of the package of FIG. 1.
FIG. 3 is a fragmentary horizontal sectional view taken along the line 3—3 of FIG. 1 and shows the specific interlock between the retaining sleeve and the two containers.
FIG. 4 is a plan view on a reduced scale of a blank for the retaining sleeve.
FIG. 5 is a fragmentary side elevational view of a similar package utilizing a slightly modified form of retaining sleeve.
FIG. 6 is a fragmentary plan view of one end of the blank from which the retaining sleeve of FIG. 5 is formed.

Referring now to the drawings in detail, it will be seen that there is illustrated in FIGS. 1 through 4 a preferred embodiment of the invention. The package is generally identified by the numeral 10 and includes two containers 12 disposed in end-to-end relation and retained in that relation by means of a retaining sleeve generally identified by the numeral 14.

It is to be understood that the containers 12 are of conventional construction and normally will be in the form of bowls (dishes) 16 having replacable covers 18. Each bowl 16 is provided about its open end with a peripheral rib 20 over which a reversely turned flange portion 22 of the associated cover 18 is engaged.

In a preferred embodiment of the retaining sleeve 14, as is best shown in FIG. 1, the retaining sleeve is of a polygonal cross section (hexagonal) and includes a plurality of flat panels 18. Each of the panels 18 is provided with an elongated notch 20 of a width corresponding to twice the thickness of the covers 18 in the flange area. Thus there is a snug fit of the covers within the notches 20.

The retaining sleeve 16 also includes a hanger portion, generally identified by the numeral 22. The hanger portion 22 is separately formed from the material of the panels 18 and is of a generally Y-shaped configuration. In actuality, the hanger portion 22 is formed of two strips 24 disposed in face-to-face relation with each strip 24 including a generally triangular hanger panel 26 and a generally rectangular securing panel 28. The securing panels 28 are bonded to terminal portions of the strip whereas the hanger panels 26 are bonded to one another. A suitable opening 30 is formed through the hanger panels 26 adjacent the apices thereof.

Referring now to FIG. 4 in particular, it will be seen that the retaining strip is formed as an elongated strip 32 preferably formed of paperboard. The strip 32 is provided with transverse fold lines 34 so as to define the panels 18. The two halves of the hanger portion 22 are bonded to the remote ends of the strips 32 after which the strips 32 are wrapped around the two containers 12. The hanger panels 26 are then bonded together by means of suitable adhesive 36 applied thereto.

It will be readily apparent that in view of the nature of the interlock between the containers and the retaining strip 14, not only are the containers retained within the retaining strip for ease of handling and display, but also the retaining strip serves to aid in retaining the covers on the bowls.

It is also pointed out here it is feasible to form a retaining strip wherein the hanger 14 thereof is integral therewith. Accordingly, reference is made here to FIG. 5 and 6 wherein a strip 38 corresponding generally to the strip 32 has formed integral with one end thereof a pair of hanger panels 40 and a securing panel 42. As is best shown in FIG. 6, the hanger panels 50 may be held together by means of adhesive 44. Then after the strip 38 has been engaged with the two containers 12, the securing panel 42 may be secured to the terminal panel 18 by means of adhesive 46.

Although only several preferred embodiments of the invention have been specifically illustrated and described herein, it is to be understood that minor variations may be made therein without departing from the spirit and the scope of the invention as defined in the appended claims.

We claim:

1. A container package comprising a pair of containers disposed in end-to-end relation, each of said containers having a peripheral projection at a respective one of said ends, and retaining sleeve telescoped over said containers and extending about said containers in a peripheral direction, said retaining sleeve being of a generally polygonal section including a plurality of flat panels, and a notch fully in each of said flat panels having said container peripheral projections extending therethrough in interlocked relation.

2. The container package of claim 1 wherein each of said flat panels has remote free edges disposed in generally parallel relation, and each panel notch being elongated generally parallel to said free edges.

3. The container package of claim 2 wherein each of said notches is generally centered relative to the respective panel.

4. The container package of claim 1 wherein said retaining sleeve is of a lesser length than the combined heights of said pair of containers.

5. The container package of claim 1 wherein said retaining sleeve has remote open ends, and said containers have oppositely facing remote ends exposed through said open ends, one container only being exposed through each retaining sleeve open end.

6. The container package of claim 1 wherein each of said notches is generally centered relative to the respective panel.

7. The container package of claim 1 wherein said notches are centered on a general plane extending between said containers.

8. The container package of claim 1 wherein said container ends are of a circular outline and said retaining sleeve is a regular polygon.

9. The container package of claim 1 wherein said retaining sleeve is of the wrap around type including a hanger portion, said hanger portion has a suspension opening therethrough having an axis centered on a plane passing between said containers.

10. The container package of claim 1 wherein said containers include tops and bottoms, said retaining sleeve has open ends, and said container bottoms are exposed through said retaining sleeve open ends.

11. The container package of claim 1 wherein said retaining sleeve is of the wrap around type including a hanger portion, said hanger portion is separately formed from the remainder of said retaining sleeve and has remote end portions secured to end portions of said sleeve.

12. The container package of claim 11 wherein said hanger portion is of a Y-shaped section.

13. The container package of claim 1 wherein each of said containers has a peripheral rib engaged by a respective cover, and said peripheral ribs project through said notches with said retaining sleeve holding said covers on said containers.

14. The container package of claim 13 wherein said container each has a peripheral rib engaged by a respective cover, and said peripheral ribs project through said notches with said retaining sleeve holding said covers on said containers.

15. The container package of claim 14 wherein the width of each notch is equal substantially to the combined thickness of said covers.

* * * * *